US011065663B2

(12) United States Patent
Duenckelmeyer et al.

(10) Patent No.: US 11,065,663 B2
(45) Date of Patent: Jul. 20, 2021

(54) DEVICE AND METHOD FOR SHAPING WORKPIECES BY MEANS OF MAGNETIC PULSE FORMING

(71) Applicant: Bayerische Motoren Werke Aktiengesellschaft, Munich (DE)

(72) Inventors: Matthias Duenckelmeyer, Munich (DE); Christian Sperl, Buchloe (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 79 days.

(21) Appl. No.: 16/169,821

(22) Filed: Oct. 24, 2018

(65) Prior Publication Data

US 2019/0060971 A1 Feb. 28, 2019

Related U.S. Application Data

(63) Continuation of application No. PCT/EP2017/057040, filed on Mar. 24, 2017.

(30) Foreign Application Priority Data

Apr. 25, 2016 (DE) ..... 10 2016 206 943.8

(51) Int. Cl.

| | |
|---|---|
| ***B21D 26/14*** | (2006.01) |
| ***B30B 1/42*** | (2006.01) |
| ***H01F 7/06*** | (2006.01) |
| ***H01F 41/02*** | (2006.01) |

(52) U.S. Cl.

CPC ..... *B21D 26/14* (2013.01); *B30B 1/42* (2013.01); *H01F 7/06* (2013.01); *H01F 41/02* (2013.01)

(58) Field of Classification Search

CPC .. B21D 26/14; B30B 1/42; H01F 7/06; H01F 41/02

See application file for complete search history.

(56) References Cited

U.S. PATENT DOCUMENTS

| | | | | |
|---|---|---|---|---|
| 2008/0072644 | A1* | 3/2008 | Umeno | B21D 39/021 72/131 |
| 2010/0175446 | A1* | 7/2010 | Jones | B21D 26/14 72/54 |
| 2017/0326614 | A1* | 11/2017 | Kim | B21D 26/06 |

FOREIGN PATENT DOCUMENTS

| | | | |
|---|---|---|---|
| CN | 101590501 | A | 12/2009 |
| CN | 102486509 | A | 6/2012 |
| CN | 103341546 | A | 10/2013 |

(Continued)

OTHER PUBLICATIONS

Chinese Office Action issued in Chinese counterpart application No. 201780008303.X dated Apr. 2, 2019 (Nine (9) pages).

(Continued)

*Primary Examiner* — Jun S Yoo

(74) *Attorney, Agent, or Firm* — Crowell & Moring LLP

(57) ABSTRACT

An installation and method for forming a workpiece, in particular for forming sheet-metal body panels, includes a first magnetic forming device which includes a first forming tool and a first magnetic tool and a second magnetic forming device which includes a second forming tool and a second magnetic tool. The first magnetic forming device is configured to form the workpiece in a first magnetic forming process and the second magnetic forming device, subsequent to the first magnetic forming process, is configured to further form the workpiece in a second magnetic forming process.

8 Claims, 2 Drawing Sheets

(56) References Cited

FOREIGN PATENT DOCUMENTS

| | | | |
|---|---|---|---|
| CN | 105344972 | A | 2/2016 |
| DE | 10 2013 019 634 | A1 | 5/2015 |
| FR | 2 913 899 | A1 | 9/2008 |
| JP | 2001-252788 | A | 9/2001 |
| JP | 2004-130349 | A | 4/2004 |
| JP | 2010-99685 | A | 5/2010 |

OTHER PUBLICATIONS

PCT/EP2017/057040, International Search Report dated May 23, 2017 (Two (2) pages).
German Search Report issued in German counterpart application No. 10 2016 206 943.8 dated Jan. 23, 2017, with Statement of Relevancy (Eight (8) pages).

* cited by examiner

DEVICE AND METHOD FOR SHAPING WORKPIECES BY MEANS OF MAGNETIC PULSE FORMING

CROSS REFERENCE TO RELATED APPLICATIONS

This application is a continuation of PCT International Application No. PCT/EP2017/057040, filed Mar. 24, 2017, which claims priority under 35 U.S.C. § 119 from German Patent Application No. 10 2016 206 943.8, filed Apr. 25, 2016, the entire disclosures of which are herein expressly incorporated by reference.

BACKGROUND AND SUMMARY OF THE INVENTION

Specified is an installation for forming workpieces by means of magnetic pulse forming. Furthermore specified is a method for forming workpieces, in particular a magnetic forming method for forming sheet-metal body panels.

Magnetic forming is an electrodynamic high-energy forming method for cold forming flat and cylindrical semi-finished products from electrically conductive materials by means of pulsed magnetic fields. The workpiece that is positioned in the proximity of the coil is formed in a non-contacting manner, that is to say without any mechanical contact with a tool on the side facing the magnet, by way of the influence of force of a pulsed magnetic field of very high intensity. Neither surface contaminations nor tool impressions arise on account thereof.

The magnetic forming method is based on the physical fact that a temporally modified magnetic field induces eddy currents in neighboring electrically conducting members. The intensity of the currents induced, and thus the effect of force on the workpiece, depend decisively on the electrical conductivity of the material used. The magnetic field exerts forces on these currents, the intensity of the forces depending on spatial gradients of the magnetic flux density and on the magnitude of the currents induced, such that the conducting member to be formed is imparted a force that is counter to the coil direction. This force acts for only a few microseconds, while the discharge of the capacitors takes place. In this time, the workpiece absorbs the required forming energy in the form of an impulse, on account of which the workpiece is accelerated and reaches velocities up to 300 m/s. Consequently, the stresses arising in the workpiece reached such a level that yielding in the context of forming technology arises, and the shape of the tool that lies below the workpiece is assumed.

Magnetic fields that are suitable for magnetic forming are generated, for example, in that charged capacitors by way of a coil that is adapted to the workpiece geometry are discharged in the course of several 10 microseconds, on account of which a very high magnetic field impulse is created in the region of the workpiece surface. The magnetic forces cause an expansion of the coil and a movement of the workpiece toward lower fields.

Depending on the arrangement of the two effective partners, that is to say of the coil and the forming tool, three basic forms of the method are to be differentiated, specifically compression, expansion, and flat forming. In the case of flat forming, a planar, helical coil is usually disposed so as to be parallel with a flat sheet-metal workpiece which lies on a forming tool, or a die, respectively, that lies below the sheet-metal workpiece. When the magnetic field is generated directly above the material the latter on account of the electromagnetic forces is pushed into the depressions of the forming tool, or of the die, respectively. The magnetic field herein acts as is the case in a conventional press ram.

The pulsed magnetic field can be very precisely metered, on account of which pressing of metals onto glass, plastics materials, composite materials or metals is possible at a high precision in terms of reproducibility. Magnetic fields and magnetic forces act in an unimpeded manner through materials such as glass, ceramics, and plastics material, magnetic forming therefore also being able to be applied under a vacuum, a protective gas atmosphere, or under clean-room conditions. Forming is likewise possible in a liquid (for example water). The magnetic impulse herein is transmitted in the form of a wave through the fluid. The advantage herein is that a tool is required only on one side, and that high degrees of deformation can be implemented. The very short process time of less than 0.1 seconds enable a rapid mass production of components as long as the required energy from capacitors is available. A good conductivity of the material to be formed is a precondition for the application of the method.

High-tensile steel and aluminum alloys, for example, can be cold formed by magnetic forming in an almost arbitrary manner without fissures arising in the material.

The term "forming" is the generic term for all production methods in which metals or thermoplastic plastics materials are plastically shaped in a targeted manner. Herein, a primary-shaped precursor material is formed to a semi-finished product, or workpieces are generated from the semi-finished product. The material in the forming herein retains its mass and its cohesion. Forming is distinguished from deforming in that the change of shape is incorporated in a targeted manner. By contrast, deforming is a non-targeted plastic change of shape.

Forming lines which are presently known in the prior art have a multiplicity of presses and deep-drawing plants in which strong steels and high-tensile steels are cold formed, semi-hot formed, or hot formed. To this end, the material in some instances is heated in the press, or the deep-drawing plant, respectively, and is subsequently formed. One forming is usually carried out per station, so that the workpieces are manually or fully automatically transported between the individual stations.

Forming in a plurality of steps can have various reasons, one of the latter being the limited formability of the material per operating step. Components are sometimes reheated between the forming steps, so as to reduce the stresses that are incorporated in the material in the forming. This results in a high input of energy and a comparatively long process time. In general, much energy is required for forming and for heating the material in the forming of steel.

The forming lines currently used often have high plant costs and, in particular in the case of the hot-forming process, a high energy consumption, inter-alia because heating the metal sheets is required for deforming in the case of the hot-forming process. In the case of metal forming, further limitations are provided by long forming times on account of limited degrees of forming.

Proceeding from the prior art it is therefore an object of at least some embodiments to specify an installation for forming workpieces by way of which at least part of the disadvantages mentioned can be avoided. It is a further object to specify a method for forming a workpiece.

These objects are achieved by the subject matter according to the independent patent claims. Advantageous embodiments and refinements are furthermore derived from the dependent patent claims, from the description hereunder, and from the drawings.

An installation, described herein, for forming workpieces according to at least one embodiment includes a first magnetic forming device and a second magnetic forming device. The installation can be configured in particular for forming metal sheets, for example sheet-metal body panels. The first magnetic forming device preferably has at least one first forming tool and at least one first magnetic tool. The second magnetic forming device preferably has at least one second forming tool and at least one second magnetic tool. The forming tools can in each case be, for example, dies. The magnetic tools can in each case comprise one or a plurality of coils.

The first magnetic forming device is preferably configured to form a workpiece such as, for example, a metal sheet, in a first magnetic forming process. The second magnetic forming device, subsequent to the first magnetic forming process, is preferably configured to further form the workpiece in a second magnetic forming process. The installation for forming workpieces can be configured, for example, as a forming line, or a magnetic forming line. The first magnetic forming process herein and hereunder can also be referred to as the first forming procedure. The second magnetic forming process herein and hereunder can also be referred to as the second forming procedure.

According to a further embodiment, the first magnetic forming device and the second magnetic forming device are configured as forming devices that are directly mutually adjacent. In other words, the installation for forming can be configured in such a manner that no further forming devices are provided between the first magnetic forming device and the second magnetic forming device. The first magnetic forming device and the second magnetic forming device can thus be disposed so as to be directly mutually adjacent within one forming line.

According to a further embodiment, the installation for forming additionally to the first and the second magnetic forming device has one or a plurality of further forming devices which in particular can likewise be configured as magnetic forming devices.

As compared with conventional forming installations, the productivity, the effectivity, and the energy efficiency of a forming line can be significantly increased by way of an installation described herein. High degrees of formation can be achieved inter-alia in the case of high-tensile steels on account of the magnetic forming. Likewise, components can be provided with the new design on account of the basic concept of the method. On account thereof, reductions in terms of weight and costs can be achieved, for example by redesigning a plurality of components so as to form one component.

According to a further embodiment, the installation for forming workpieces has a changeover device for changing over the magnetic tools. The changeover device can be configured in such a manner, for example, that the first magnetic tool and the second magnetic tool can be changed over after a first forming procedure, or magnetic forming process, respectively. For example, the first magnetic tool used in a first forming procedure can be moved away by means of the changeover device immediately after the first forming procedure. The second magnetic tool can then be moved to the correct position by the changeover device such that the second forming procedure, or the second magnetic forming process, respectively, can be carried out with the aid of the second magnetic tool.

According to a further embodiment, the installation for forming workpieces has a changeover device for moving or changing, respectively, the first forming tool and/or the second forming tool. The changeover device can be configured, for example, to displace and/or rotate and/or pivot the first forming tool and/or the second forming tool. For example, the first forming tool by means of the changeover device can be moved away immediately after a first forming procedure in which the first forming tool has been used. The second forming tool can then be moved to the correct position preferably by the changeover device, so as to carry out the second forming procedure, or the second magnetic forming process, respectively, while using the second forming tool.

According to a further embodiment, the installation is configured in such a manner that the first forming tool and the second forming tool are in each case disposed on a tool table. The tool tables hereunder can also be referred to as support tables. For example, the forming tools can in each case be fastened on a tool table. The tool tables can be moved, in particular displaced and/or pivoted and/or rotated, preferably by means of the changeover device for changing over the forming tools.

According to a further embodiment, the installation for forming workpieces has a handling device. The handling device, upon the termination of the first magnetic forming process, is preferably configured to supply the workpiece to the second magnetic forming device. The handling device can in particular be configured in such a manner that the workpiece, upon the first magnetic forming process, by means of the handing device can be removed from the first forming tool and be disposed on the second forming tool. The handling device can be configured, for example, as a robot, or as a manipulator, respectively. The handing device preferably has one or a plurality of grippers by means of which the workpiece can be gripped.

According to a further embodiment, the first magnetic tool differs from the second magnetic tool. The magnetic tools can differ from one another in particular in terms of, for example, the shape, size, and/or output thereof.

Furthermore specified is a method for forming a workpiece. The method can in particular be a method for forming a metal sheet, for example a sheet-metal body panel. In the method, an installation described herein for forming workpieces is provided. The installation can have one or a plurality of features of the aforementioned embodiments. At least one workpiece to be formed is furthermore provided.

In a first forming procedure, the workpiece is formed by means of the first magnetic forming device. In other words, the workpiece is formed in a first magnetic forming process while using the first magnetic tool and the first forming tool. Thereafter, the workpiece is further formed in a second forming procedure by means of the second magnetic forming device, that is to say while using the second magnetic tool and the second forming tool. The second forming procedure is preferably performed immediately after the first forming procedure, that is to say that no further forming procedures take place between the first forming procedure and the second forming procedure.

According to a further embodiment, the first magnetic tool and the second magnetic tool are changed over between the first forming procedure and the second forming procedure. For example, the first magnetic tool, upon the termination of the first forming procedure, can be moved away by way of a change over device, for example. The second magnetic tool can then, for example likewise by way of the changeover device, be moved to the correct position such that the second forming procedure can be carried out by means of the second magnetic tool. For example, the second magnetic tool, once the first magnetic tool has been moved away, can be moved to the same position at which the first magnetic tool was disposed during the first forming procedure.

According to a further embodiment, the first forming tool and/or the second forming tool are moved between the first forming procedure and the second forming procedure. For example, the forming tools can be displaced and/or pivoted and/or rotated between the two forming procedures. A changeover device can be used herein, for example. The forming tools can in each case be disposed on a tool table, for example, wherein the tool tables can be displaced or pivoted, respectively, by the changeover device. On account thereof, the second forming tool can advantageously be moved to the correct position so as to carry out the second magnetic forming process. For example, the second forming tool, or the associated tool table, respectively, after the first magnetic forming process can be moved by means of the changeover device to the position at which the first forming tool, or the associated tool table, respectively, was disposed during the first magnetic forming process.

According to a further embodiment, the workpiece, upon the termination of the first forming procedure, is moved to the second forming tool by way of a handling device, for example a manipulator. After the first forming procedure, the workpiece, can be removed from the first forming tool for example by way of one or a plurality of grippers, and, for example upon the forming tools having been displaced or pivoted, respectively, can be disposed on the second forming tool. The second forming procedure of the workpiece by means of the second magnetic tool and of the second forming tool can subsequently be carried out. In the case of movable forming tools or tool tables, respectively, it is furthermore possible that the workpiece, after the first forming procedure, for changing over the forming tool is only raised by the handing device and subsequently, that is to say after a changeover of the forming tool, has to be lowered again.

High degrees of formation and undercuts can advantageously be achieved in a simple manner by way of the installation described herein for forming workpieces, or by way of the method described herein, respectively. Furthermore, the installation described herein is implementable in a cost-effective manner in comparison with conventional press lines. The method is moreover distinguished by low forming times of, for example, less than 0.1 seconds, and by a low consumption of energy, in particular since no heating of the workpieces is required.

Further advantages and advantageous embodiments of the installation described herein for forming workpieces, and of the method described herein, are derived from the embodiments described hereunder in conjunction with FIGS. 1 and 2.

Other objects, advantages and novel features of the present invention will become apparent from the following detailed description of one or more preferred embodiments when considered in conjunction with the accompanying drawings.

DETAILED DESCRIPTION OF THE DRAWINGS

The same component parts or component parts of equivalent function can in each case be provided with the same reference signs in the exemplary embodiments and Figures. The elements illustrated and the mutual size ratios thereof are to be considered as not to scale in principle. Rather, individual elements can be illustrated so as to be dimensioned in an exaggerated thick or large manner for the sake of improved illustrative clarity and/or understanding.

Figure 1:
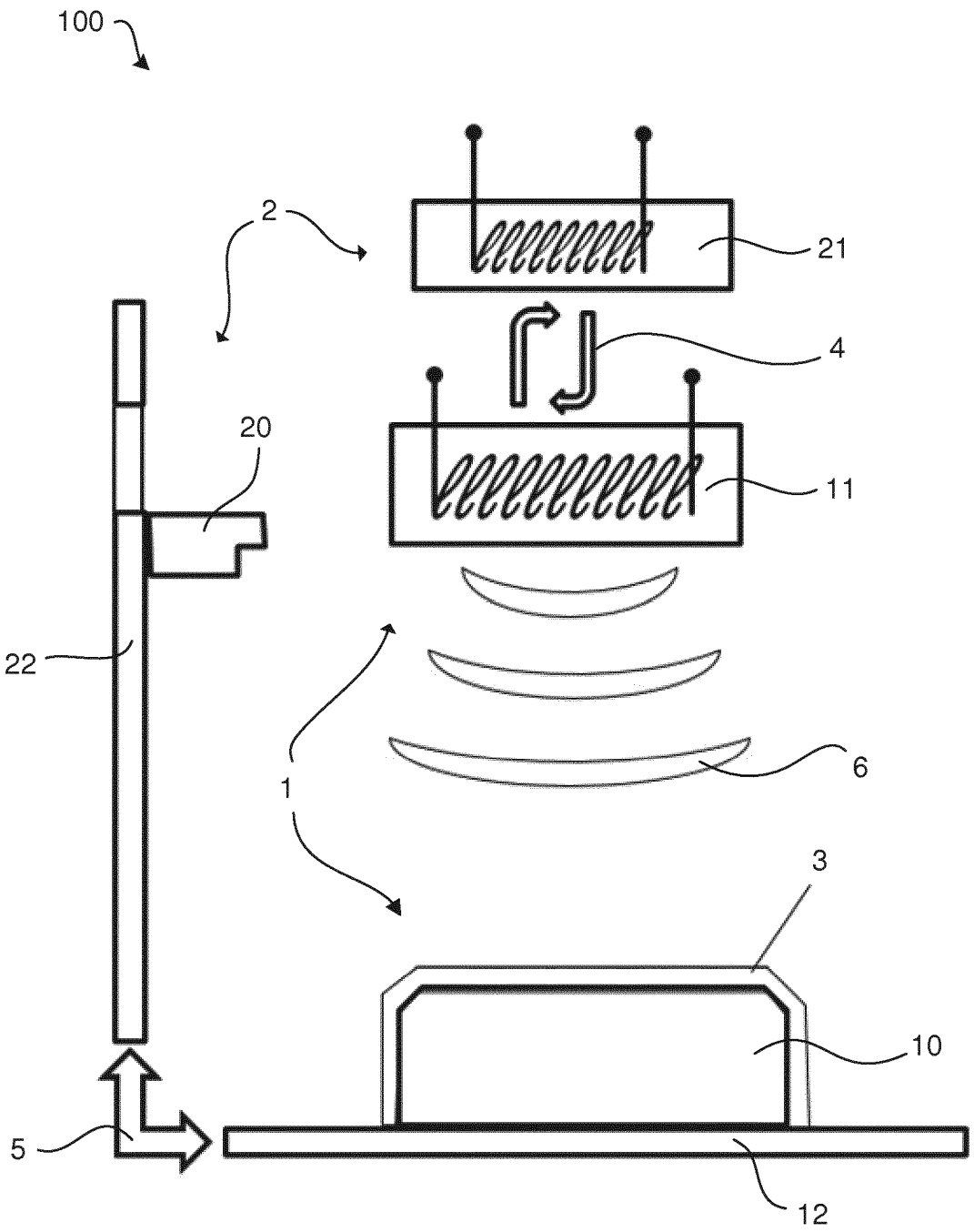
FIG. 1 shows a schematic illustration of an installation for forming workpieces according to one exemplary embodiment.
Figure 2:
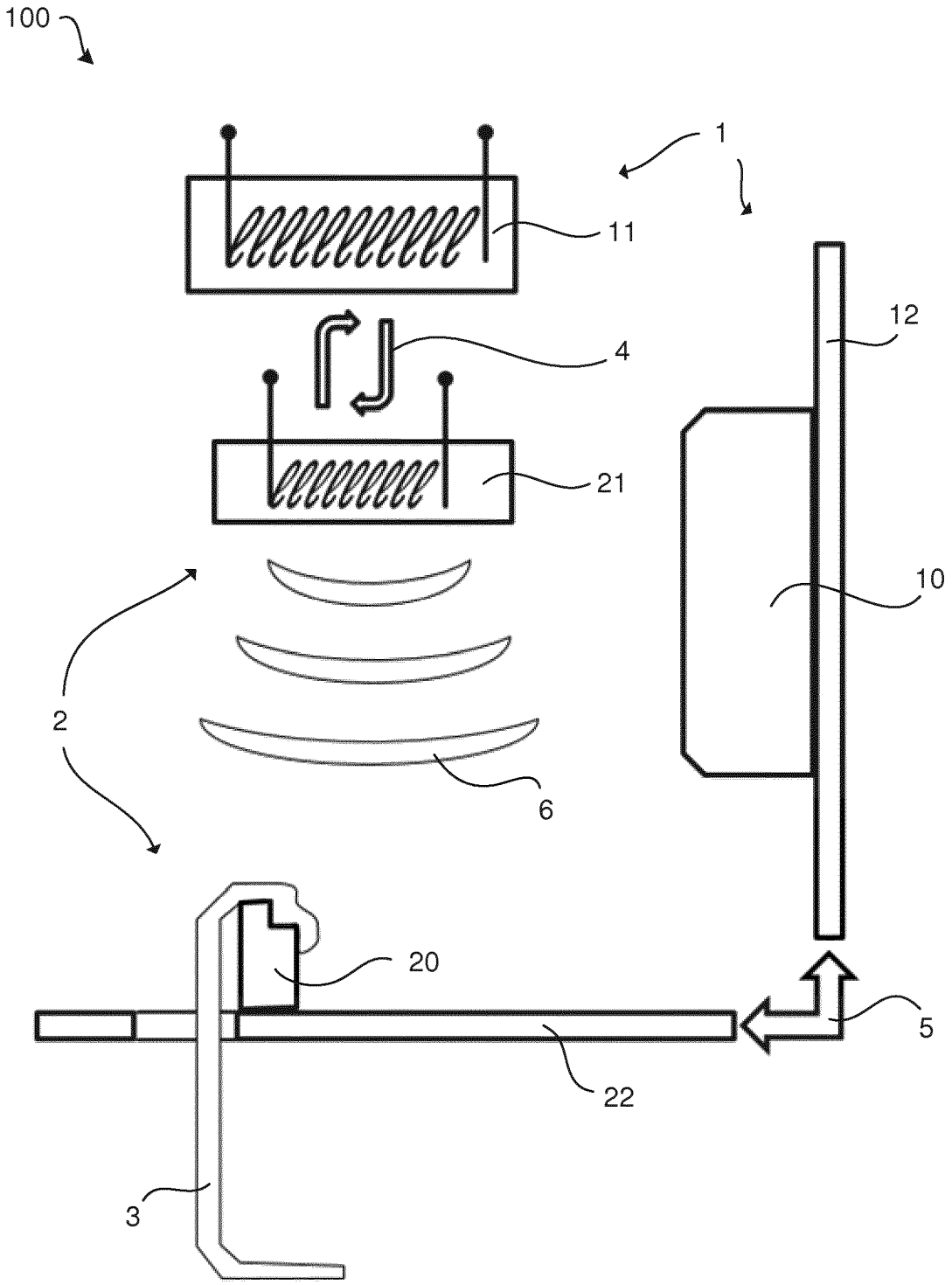
FIG. 2 shows a further schematic illustration of the installation for forming workpieces from FIG. 1.

FIGS. 1 and 2 show in each case a schematic illustration of an installation 100 for forming workpieces 3, according to one exemplary embodiment. The installation 100 has a first magnetic forming device 1 having a first forming tool 10 and a first magnetic tool 11. The installation 100 furthermore has a second magnetic forming device 2 having a second forming tool 20 and a second magnetic tool 21. The forming tools 10, 20 in the exemplary embodiment illustrated are in each case configured as dies which in each case have a specific shape-imparting surface. The magnetic tools in 11, 21 comprise in each case at least one coil for generating pulsed magnetic fields.

The installation 100 furthermore has a first tool table 12 on which the first forming tool 10 is fastened, and a second tool table 22 on which the second forming tool 20 is fastened, and a changeover device 5 for changing over the work tables 12, 22. The installation 100 furthermore comprises a changeover device 4 for changing over the magnetic tools 11, 12.

The end of a first forming procedure in which a workpiece 3, for example a steel sheet, is formed by a pulsed magnetic field 6 that is generated by means of the first magnetic tool 11 is schematically illustrated in FIG. 1. The workpiece 3 when being formed is pressed onto the shape-imparting surface of the first forming tool.

After the first forming procedure, the first magnetic tool 11 and the second magnetic tool 21 are changed over by means of the changeover device 4. Upon the changeover of the magnetic tools 11, 21 the second magnetic tool 21 assumes approximately the position which was occupied by the first magnetic tool 11 during the first forming procedure. Furthermore, the first and the second tool table 12, 22 after the first forming procedure are changed over by means of the changeover device 5, wherein the workpiece 3 for the changeover of the tool tables 12, 22 is briefly raised by means of a manipulator (not illustrated) and after the changeover is lowered in such a manner that the workpiece is disposed on the second forming tool 20. Subsequently the workpiece 3, in a second forming procedure which is schematically shown in FIG. 2, is further formed by way of a pulsed magnetic field 6 that is generated by the second magnetic tool 21.

Almost arbitrarily high degrees of forming in strong and high-tensile steels can be achieved by way of the installation 100 shown herein. Furthermore, undercuts can be carried out in a simple manner with the aid of the magnetic forming by way of the exchangeable magnetic tools and forming tools.

Alternatively or additionally, the exemplary embodiments shown in the Figures can have further features according to the embodiments of the general specification.

LIST OF REFERENCE CHARACTERS

1 First magnetic forming device
10 First forming tool

11 First magnetic tool
12 First tool table
2 Second magnetic forming device
20 Second forming tool
21 Second magnetic tool
22 Second tool table
3 Workpiece
4, 5 Changeover device
6 Pulsed magnetic field
100 Installation for forming The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for forming a workpiece, comprising:

a single installation, wherein the single installation includes:

a first magnetic forming device which comprises a first forming tool and a first magnetic tool;

a second magnetic forming device which comprises a second forming tool and a second magnetic tool;

wherein the first magnetic forming device is configured to form the workpiece in a first magnetic forming process;

wherein the second magnetic forming device, subsequent to the first magnetic forming process, is configured to further form the workpiece in a second magnetic forming process;

a first changeover device, wherein the first changeover device changes over the first and the second magnetic tools in the single installation; and a second changeover device, wherein the second changeover device displaces and/or rotates and/or pivots the first and the second forming tools in the single installation;

wherein the first forming tool is disposed on a first movable tool table and the second forming tool is disposed on a second movable tool table;

wherein the first magnetic forming device and the second magnetic forming device are disposed in the single installation during both of the first magnetic forming process and the second magnetic forming process;

wherein the first magnetic tool and the second magnetic tool are disposed directly mutually adjacent to each other in the single installation during both of the first magnetic forming process and the second magnetic forming process;

and wherein the first forming tool is disposed on the first movable tool table in the installation during both of the first magnetic forming process and the second magnetic forming process and the second forming tool is disposed on the second movable tool table in the installation during both of the first magnetic forming process and the second magnetic forming process.

2. The apparatus as claimed in claim 1 further comprising a handling device which, upon a termination of the first magnetic forming process, is configured to supply the workpiece to the second magnetic forming device.

3. The apparatus as claimed in claim 1, wherein the first and the second magnetic tools each include a coil and wherein the first and the second forming tools are dies.

4. The apparatus as claimed in claim 1, wherein the first magnetic tool and the second magnetic tool differ from one another in terms of size, shape, and/or output.

5. A method for forming a workpiece, comprising the acts of:

providing the apparatus as claimed in claim 1;

providing the workpiece;

forming the workpiece by the first magnetic forming device in the first magnetic forming process; and further forming the workpiece by the second magnetic forming device in the second magnetic forming process;

wherein the first magnetic tool and the second magnetic tool are changed over in the single installation between the first magnetic forming process and the second magnetic forming process by the first changeover device;

wherein the first and the second forming tools are displaced and/or pivoted and/or rotated in the single installation between the first magnetic forming process and the second magnetic forming process by the second changeover device.

6. The method as claimed in claim 5, wherein the workpiece is a sheet-metal body panel.

7. The method as claimed in claim 5, wherein the second magnetic forming process is performed immediately after the first magnetic forming process.

8. The method as claimed in claim 5, wherein the workpiece upon a termination of the first magnetic forming process is moved to the second forming tool by a handling device.

* * * * *